US005153641A

United States Patent [19]

Takahashi

[11] Patent Number: 5,153,641

[45] Date of Patent: Oct. 6, 1992

[54] CONTROL CIRCUIT FOR DESIGNATING PAPER FEED OPENING TO WHICH OPTIMUM KIND OF COPY SHEET IS TO BE SET IN IMAGE FORMING APPARATUS

[75] Inventor: Kenichi Takahashi, Toyohashi, Japan

[73] Assignee: Minolta Camera Kabushiki Kaisha, Osaka, Japan

[21] Appl. No.: 773,199

[22] Filed: Oct. 8, 1991

[30] Foreign Application Priority Data

Oct. 12, 1990 [JP] Japan ..... 2-275070

[51] Int. Cl.[5] ..... G03G 15/00

[52] U.S. Cl. ..... 355/209; 355/309

[58] Field of Search ..... 355/205-209, 355/309, 311, 308; 271/9

[56] References Cited

U.S. PATENT DOCUMENTS 4,881,104 11/1989 Kusumoto et al. ..... 355/309

4,949,124 8/1990 Kusumoto et al. ..... 355/203

*Primary Examiner*—Joan H. Pendegrass

*Attorney, Agent, or Firm*—Willian Brinks Olds Hofer Gilson & Lione

[57] ABSTRACT

When a paper feed opening to which a selected optimum kind of sheet is to be set is not detected, a control circuit gives instructions to set the optimum kind of sheet in an empty paper feed opening if it is available. If the empty paper feed opening is not available, the control circuit gives instructions to set the sheet in a paper feed opening whose frequency in use is the lowest among a plurality of paper feed openings.

17 Claims, 11 Drawing Sheets

200
CPU
201
102
103
104
105
106
107
108
109
110
111
112
113
114
115
116
DECODER
MEMORY
VIDEO RAM
LCD CONTROLLER
117
LCD
LCD DRIVER
INPUT
OUTPUT

Fig. 8

SET A4 IN SECOND STAGE
PAPER FEED OPENING

Fig. 9

SET B5 IN MANUAL
PAPER FEED OPENING

CONTROL CIRCUIT FOR DESIGNATING PAPER FEED OPENING TO WHICH OPTIMUM KIND OF COPY SHEET IS TO BE SET IN IMAGE FORMING APPARATUS

BACKGROUND OF THE INVENTION

1. Technical Field of the Invention

The present invention relates to an image forming apparatus such as a copying machine and a laser printer, and more particularly, to an image forming apparatus which is provided with a plurality of paper feed openings capable of setting sheets of different sizes (including a sheet of the same size set in different feeding directions, i.e., longitudinal and lateral directions) for automatically selecting an optimum size of sheet among the sheets set in the plurality of sheet feeding openings corresponding to the relation between the size of an original and copying magnification.

2. Description of Related Art

A variety of this sort of image forming apparatuses have heretofore been proposed and put in practical use. For instance, there is an apparatus which is arranged to give a warning to a user in the case where a sheet of the optimum size to be selected is not set. In such an apparatus, a sheet of selected size can be set quickly in response to the warning so that an image forming operation on a sheet of the optimum size can be accomplished.

In such a conventional apparatus, however, no indication is made to which paper feed opening the selected size of sheet has to be set. The user thus simply selects a paper feed opening to which the sheet can be easily set. However, when all the paper feed openings are used for sheet accommodation, the selected sheet of the optimum size can not be set unless a sheet already set in one of the paper feed openings is removed. At this stage, a trouble happens if a wrong sheet is removed. It may happen, for instance, that a sheet which is frequently used is replaced with said optimum size of sheet. In such a case, there is a high probability that the sheet in frequent use has to be replaced again with the optimum size of sheet after an image forming operation has been completed. If the sheet in frequent use is removed from a paper feed opening and is left out of the opening, the sheet has to be set again in the paper feed opening upon receiving a warning after image forming operation has started whereby the image forming operation can not be carried out smoothly.

There is another case that a large number of sheets set in a paper feed opening is replaced with a sheet of the optimum size. In such a case, the large number of sheets weighs heavily and it is troublesome to replace them again. It is improper to leave the large number of sheets out of the apparatus.

SUMMARY OF THE INVENTION

A main object of the present invention is to provide an image forming apparatus which is capable of solving the above-mentioned problems wherein an arrangement is made so as to designate a paper feed opening other than the paper feed opening in which a sheet which may cause a trouble is set when a sheet of the optimum size to be selected is not set.

An image forming apparatus according to the present invention comprises a plurality of paper feed openings capable of setting different kinds of sheets for feeding the sheets for image forming operations, means for determining an optimum kind of sheet corresponding to a condition of the image forming operation, detecting means for detecting a paper feed opening wherein an optimum kind of sheet is set, and control means for designating a paper feed opening to which the optimum kink of sheet has to be set when an opening in which the optimum kind of sheet is set is not detected by the detecting means.

These and other objects and features of the present invention will become apparent from the following description taken in conjunction with the accompanying drawings which illustrate specific embodiments of the invention.

BRIEF DESCRIPTION OF THE DRAWINGS

FIGS. 8 and 9 are front views showing examples how sheet setting designation is displayed on LCD display section.

DESCRIPTION OF THE PREFERRED EMBODIMENTS

Figure 1:
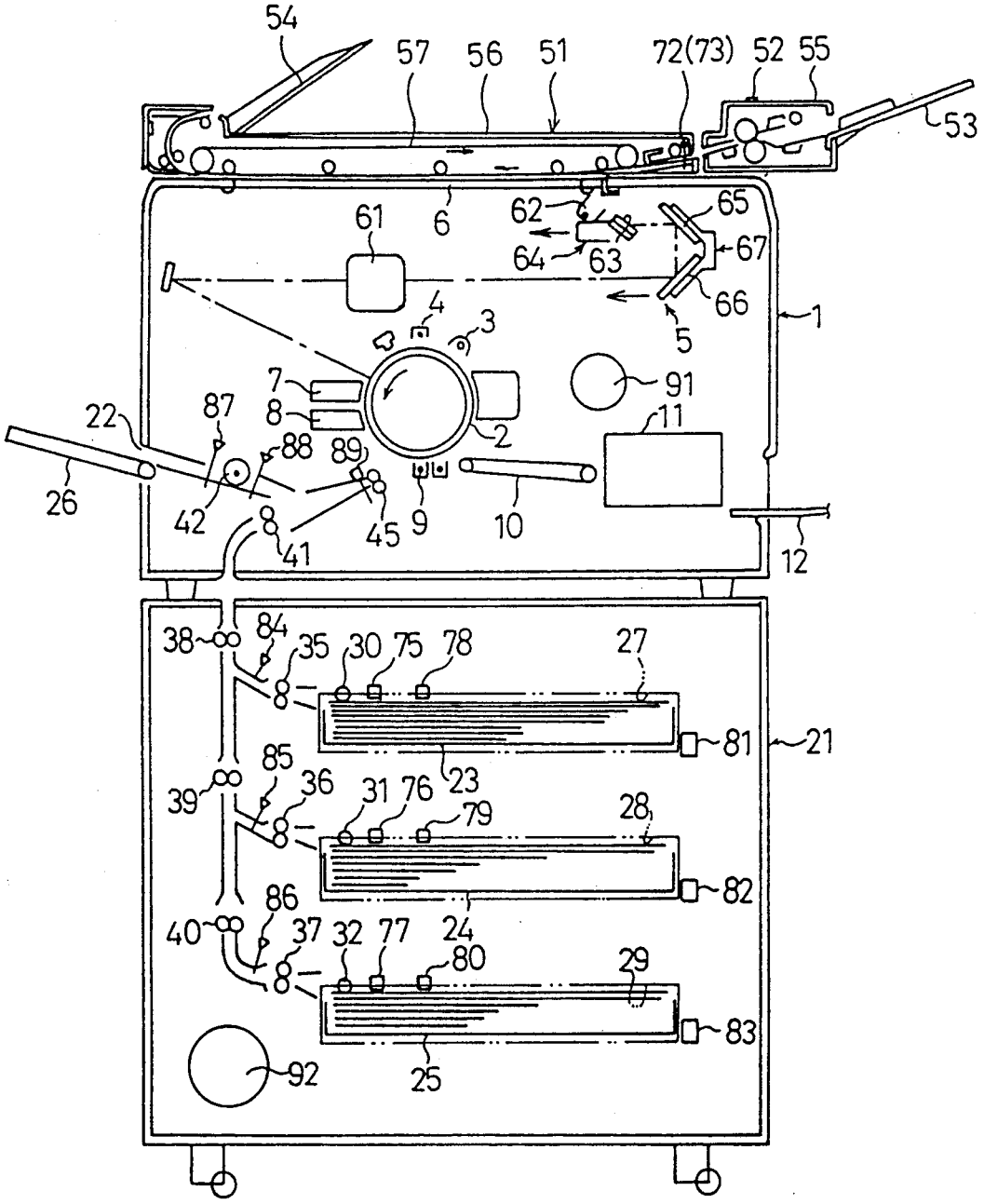
FIG. 1 is a schematic structural view showing the entire construction of a copying machine to which an embodiment of the present invention is applied.

An embodiment of the present invention will be described hereinafter referring to the drawings.

The embodiment is applied to a copying machine, and the entire construction of the copying machine is shown in FIG. 1.

A machine body 1 is placed on a paper feed unit 21, and an automatic original transport device 51 is provided on the machine body 1. Substantially in the center of the body 1, there is provided a photoconductive drum 2. The photoconductive drum 2 is rotatively driven in the direction of the arrow and the image forming area is uniformly charged by an eraser lamp 3 and a charger 4. On the charged surface, an image of an original positioned on a platen glass 6 provided on the upper surface of the machine body 1 is exposed by an exposure optical system 5, and an electrostatic latent image corresponding to the original image is formed.

The electrostatic latent image formed on the photoconductive drum 2 is developed by a developing device either 7 or 8 to form a visualized image. The visualized image on the photoconductive drum 2 is transferred onto a transfer sheet by a charger 9 when the visualized image has reached a transfer section which is positioned opposite to the charger 9.

To the transfer section, a transfer sheet which is manually supplied from a manual paper feed opening 22 or a transfer sheet set in one of paper feed cassettes 23–25 mounted in the paper feed unit 21 is fed for the image transfer process. After the transfer process, the transfer sheet is separated from the photoconductive drum 2, and then, sent to a fixing device 11 by an absorption transfer belt 10 for a fixing process. The transfer sheet after the fixing process is discharged onto a discharge tray 12 outside the machine body 1.

A table 26 for manual insertion is provided for the manual paper feed opening 22 to guide a transfer sheet manually inserted into the opening 22. Each of the paper feed cassettes 23–25 is detachably mounted in each paper feed opening 27–29 provided circumferential wall of the paper feed unit 21. Paper feed rollers 30–32 are provided on each one of the paper feed cassettes 23–25 mounted in each paper feed opening 27–29. By selectively driving one of the paper feed rollers 30–32, a transfer sheet can be fed from one of the paper feed cassettes 23–25 set in the paper feed opening 27–29.

A transfer sheet which is fed from the manual insertion table 26 or from one of the paper feed cassettes 23–25 is transported toward the transfer section by transport rollers 35–42. The transfer sheet is forwarded to a timing roller 45 which is being stopped and waiting for the next operation, and the leading end of the sheet is adjusted to prevent the transfer sheet from being skewed. Paper feed timing to the transfer section is adjusted by a drive start timing of the timing roller 45 so that the leading end of the visualized image formed on the photoconductive drum 2 corresponds with the leading end of the transfer sheet.

The automatic original transport device 51 is arranged so as to be opened and closed on the platen glass 6. The automatic original transport device 51 is electrically connected with the machine body 1. When the automatic original transport device 51 is detected by an unillustrated switch that it is closed at a predetermined position, control of the machine body 1 and the automatic original transport device 51 are correlated with each other, and an operation mode of the machine body 1 is changed over to an automatic original transport mode.

In the automatic original transport mode, the automatic original transport device 51 starts an action when a start key 52 provided with the automatic original transport device 51 is operated whereby an original set in an original tray 53 on an original forwarding section 55 is forwarded to a position between the platen glass 6 in a transport section 56 and a transport belt 57 on the platen glass 6. The original is further transported to a predetermined exposure position on the platen glass 6 by a transfer belt 57 and is stopped thereat. At this stage, a start signal is emitted from the automatic original transport device 51 to the machine body 1 to start a copying operation. When a final exposure operation to the original at the exposure position is finished, a signal is emitted to the automatic original transport device 51 from the machine body 1 to the effect that the exposure operation is finished, and the original is discharged onto a paper discharge tray 54 by the transfer belt 57.

An exposure optical system 5 is formed of a mirror scanning type wherein copying magnification can be changed by moving a projection lens 61 in the direction of the optical axis. A first slider 64 which includes an illuminating light source 62 and a first mirror 63 performs a scanning operation at a velocity of V/m (V: circumferential velocity of the photoconductive drum, m: copying magnification), while a second slider 67 which includes a second and third mirrors 65, 66 is moved at a velocity of V/2m to maintain a uniform optical length corresponding to each magnification in a scanning operation.

The machine body 1 is provided with modes for selecting a transfer sheet at the time of copying operation, i.e., an automatic paper selection mode (APS mode) for automatically selecting the size of a sheet, and a manual mode for an operator to set the size of a transfer sheet.

In the APS mode, the optimum size of a transfer sheet is judged from the size of an original exposed under a fixed copying magnification and the fixed copying magnification to automatically select a corresponding paper feed opening, and a transfer sheet is fed from the selected paper feed opening.

In the manual mode, a copying operation is conducted by optionally selecting a copying magnification and the size of a transfer sheet.

For detecting the size of an original in the APS mode, an original length detecting sensor 72 and an original width detecting sensor 73 are provided adjacent to the entrance of original inserting section in the transport section 56 of the automatic original transport device 51. By receiving detection signals from two sensors 72 and 73 at the machine side, the size and direction of an original can be detected.

The original length detecting sensor 72 is, therefore, disposed at a position where it can detect an original irrespective of the size and direction of the original so that the size of the original in the direction of transport, i.e.; length of the original, can be detected. Another one of the original width detecting sensor 73 is arranged to be able to or unable to detect an original depending on the width of an original being inserted into the original insertion opening. The mechanism for detecting the size of an original is not limited to the above-mentioned mechanisms, and a variety of known mechanisms may also be adopted.

In the paper feed unit 21, sensors 75–77 are provided for detecting the existence of transfer sheet in the paper feed cassettes 23–25 mounted in each paper feed opening 27–29 in order to supply a transfer sheet automatically selected by each one of the above-mentioned modes or manually selected. Sensors 78–80 are also provided for detecting the remaining sheets set in the paper feed cassettes 23–25. Sensors 81–83 are further provided for detecting the size of transfer sheets set in the paper feed cassettes. Paper feed sensors 84–86 are provided for detecting a transfer sheet when the sheet is fed from the paper feed cassettes 23–25 mounted in the paper feed openings 27–29.

At the manual paper feed opening 22 on the machine body 1, there is provided a manual insertion sensor 87 for detecting a transfer sheet when it is manually inserted. Another manual insertion sensor 88 is also provided for detecting a transfer sheet when it is fed. Sensor 89 is further provided for detecting a transfer sheet when a transfer sheet fed from one of said paper feed openings 27–29 or from the manual paper feed opening 22 has reached immediately before the timing roller 45 so that a timing for turning on the timing roller 45 can be determined.

In the machine body 1, there is provided a main motor 91 for driving a copying mechanism, while in the paper feed unit 21, a paper feed motor 92 is provided separately.

Figure 2:
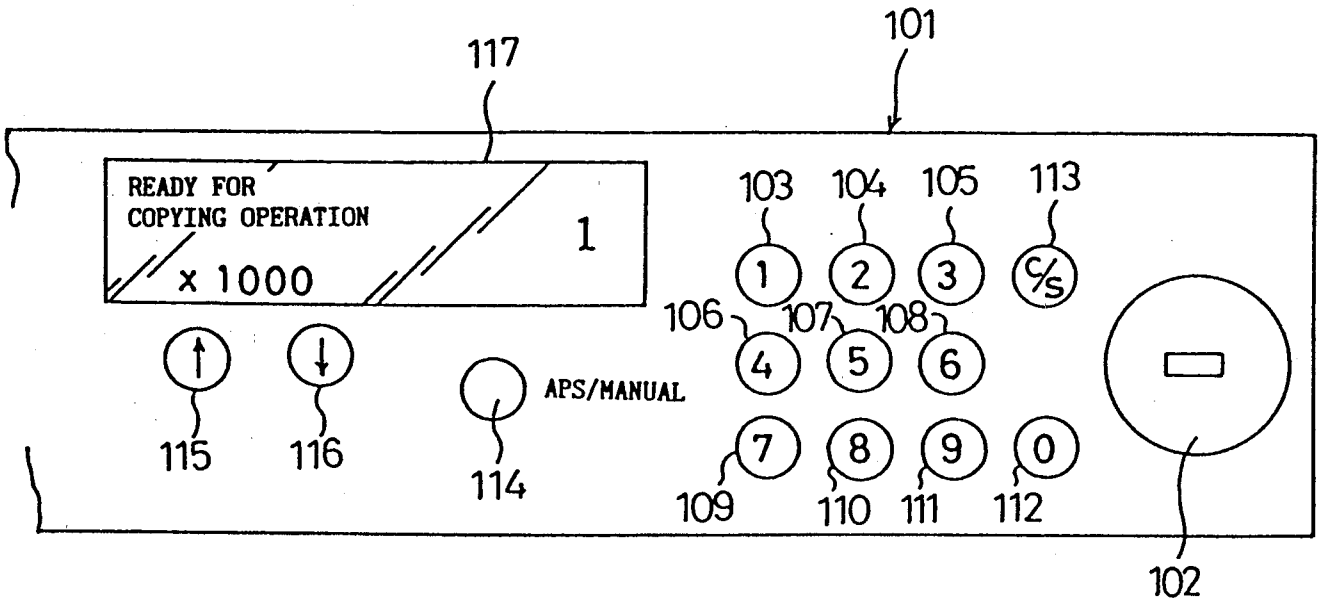
FIG. 2 is a part of a front view showing an operation panel of the copying machine.

An operation panel 101 as illustrated in FIG. 2 is provided in the machine body 1. In FIG. 2, reference numeral 102 represents a print key for starting a copying operation, 103–112 ten keys for designating numbers 1–0, 113 a clear/stop key for clearing the number of copy sheets and for stopping a copying operation, 114 a mode selection key for selecting each of the APS mode, AMS mode and manual mode, 115 and 116 up and down keys of copying magnification. Reference numeral 117 designates an LCD display section for indicating various messages to inform an operator of an optimum paper feed opening to be selected for the optimum size of a transfer sheet when the optimum size of transfer sheet which has been selected by the number, fixed magnification or APS mode is not set in any one of the paper feed openings 27–29.

Figure 3:
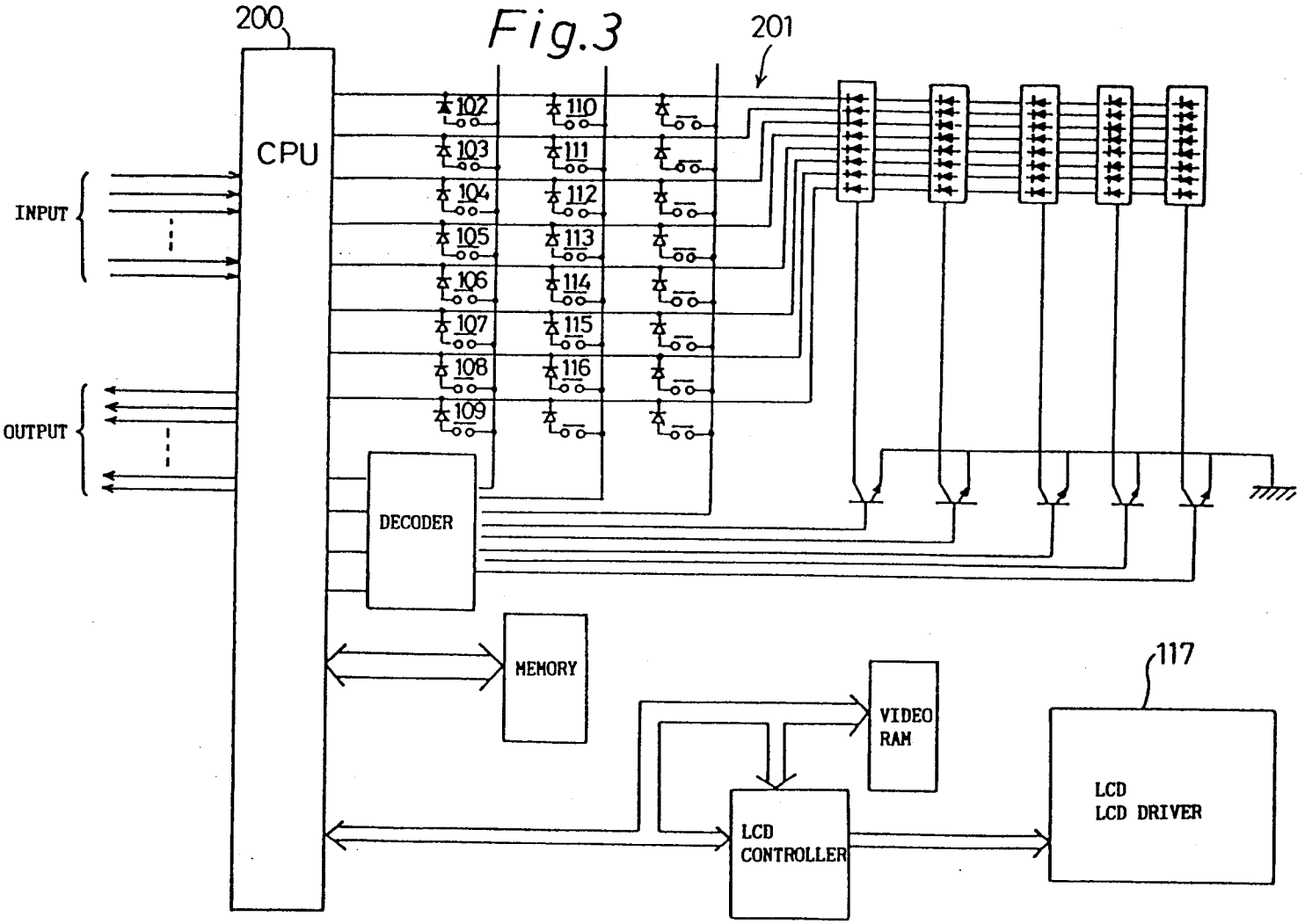
FIG. 3 is a block diagram of a control circuit.

Each of the keys described above, the contents of indication in the display section 117, input and output in the machine body 1 and paper feed unit 21 constitute a control circuit 201 with CPU200 in the central portion as shown in FIG. 3. Controls by the control circuit 201 will be described referring to FIGS. 4 through 9.

Figure 4:
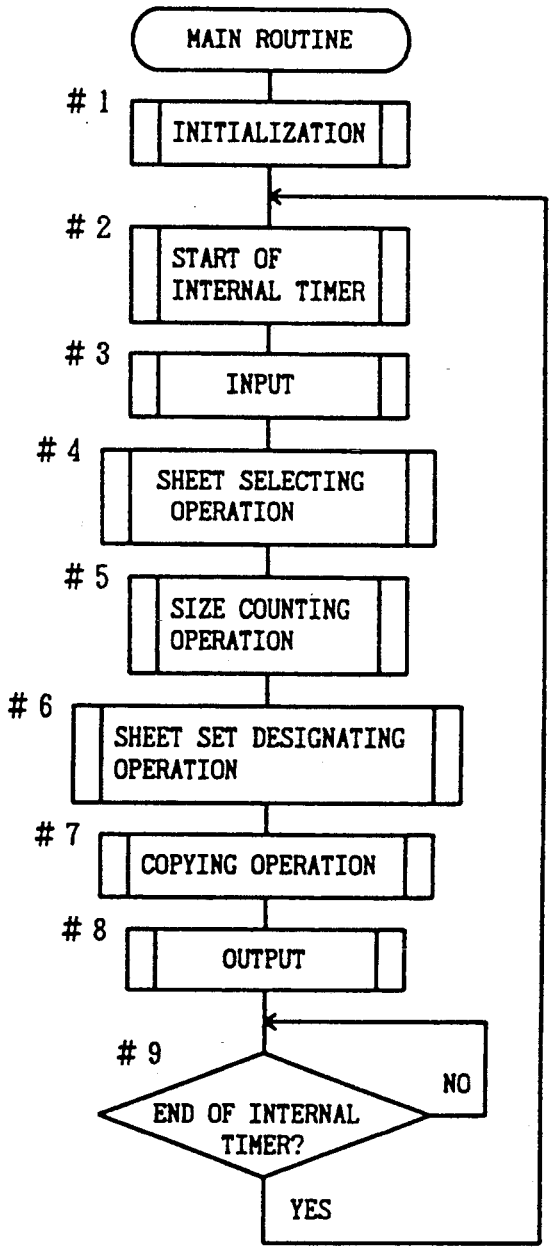
FIG. 4 is a flowchart showing a main routine of the main control by the control circuit of FIG. 3.

FIG. 4 is a flowchart showing a main routine of the CPU200. When power is applied to the machine body 1, a program is initialized for clearing a RAM in the CPU200 and for a standard copying mode (step #1). At step #2, an internal timer of CPU200 is started whereby a time required for the following one routine is controlled. At step #3, the operation panel, various sensors are inputted and processed. At step #4, an operational process is conducted for determining the optimum size of transfer sheet under the APS mode. At step, #5, a size counting operational process is conducted for counting the number of transfer sheet on each size. At step #6, an operational process for designating a paper feed opening is conducted to which an optimum size of transfer sheet determined previously is set. At step #7, a series of copying operations in the machine body from the start to the end of the copying operation is processed. At step #8, control signal and display signal are processed to indicate necessary data on the operation panel. At step #9, completion of the internal timer is judged, and the program returns to step #2 upon completion of the internal timer. Thereafter, steps #2 through #9 are repeatedly executed.

Figure 5:
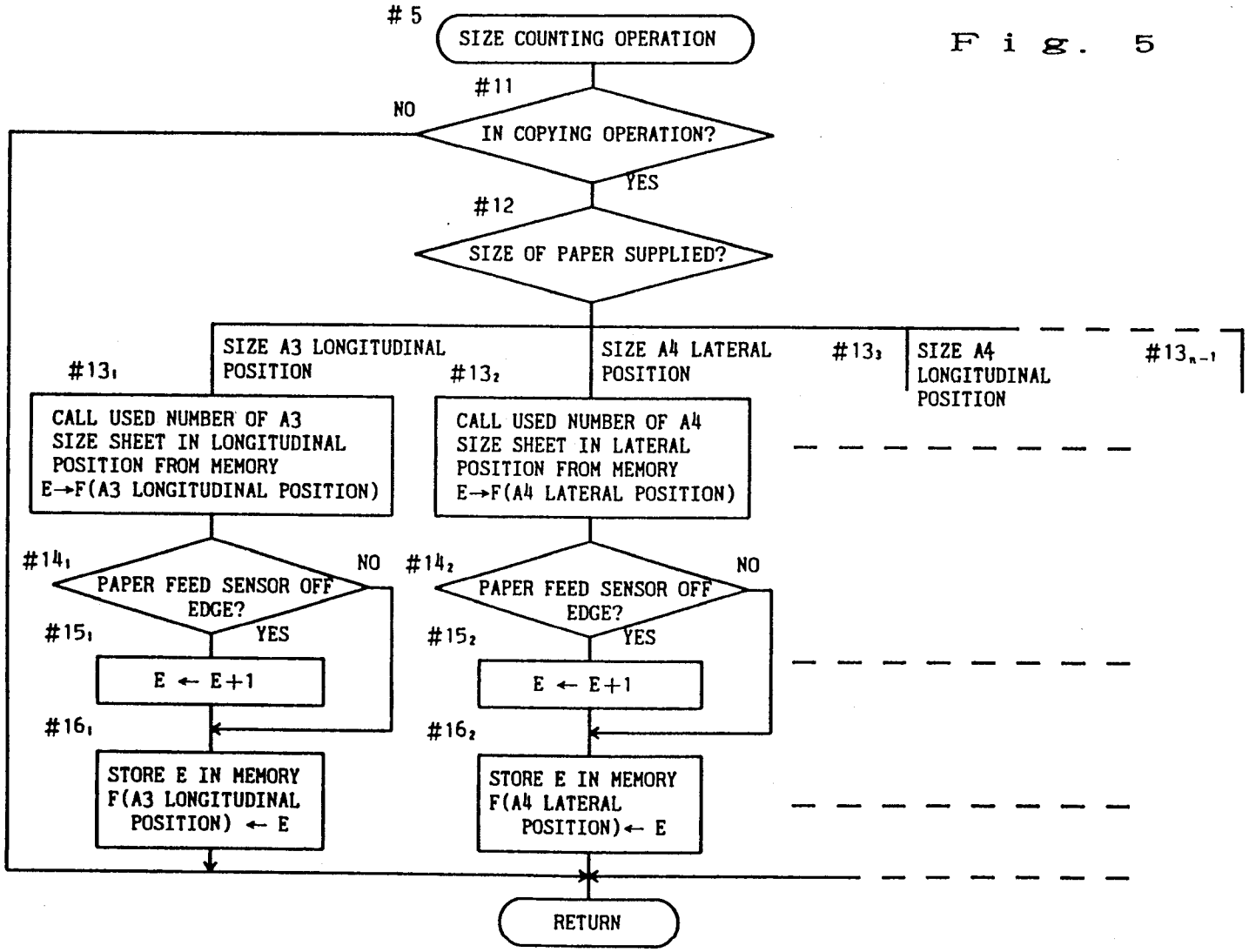
FIG. 5 is a flowchart showing a subroutine in a size count operation processing in FIG. 4.

FIG. 5 is a flowchart showing a subroutine of size counting operational process at step #5. At step #11, when copying operation is not being conducted, a program is returned. If copying operation is being conducted, the size of a transfer sheet being used at step #12 is judged among 'n' kinds of sheets. Corresponding to the judgment made, program branches into steps $\mathbf{13}_1$, $\mathbf{13}_2$, $\mathbf{13}_3$, . . $\mathbf{13}_n$ on each size. In the case where the size of a transfer sheet is A3 placed in the longitudinal direction, for instance, program proceeds to the flow of step $\mathbf{13}_1$. The number of sheets to be used F(A3) on the A3 longitudinal transfer sheet is called from memory and is stored into E. Then, one is added to the content of said E (steps $\#\mathbf{14}_1$, $\#\mathbf{15}_1$) by off edge (a time point when a sensor is changed from on state to off state) related to paper feed process of the A3 longitudinal transfer sheet, and is again stored in the F(A3). Every time when an A3 size transfer sheet is used, the number of sheets used are summed up and subsequently counted. Other sizes of transfer sheets are processed in the same manner, and therefore, description is omitted.

Figure 6:
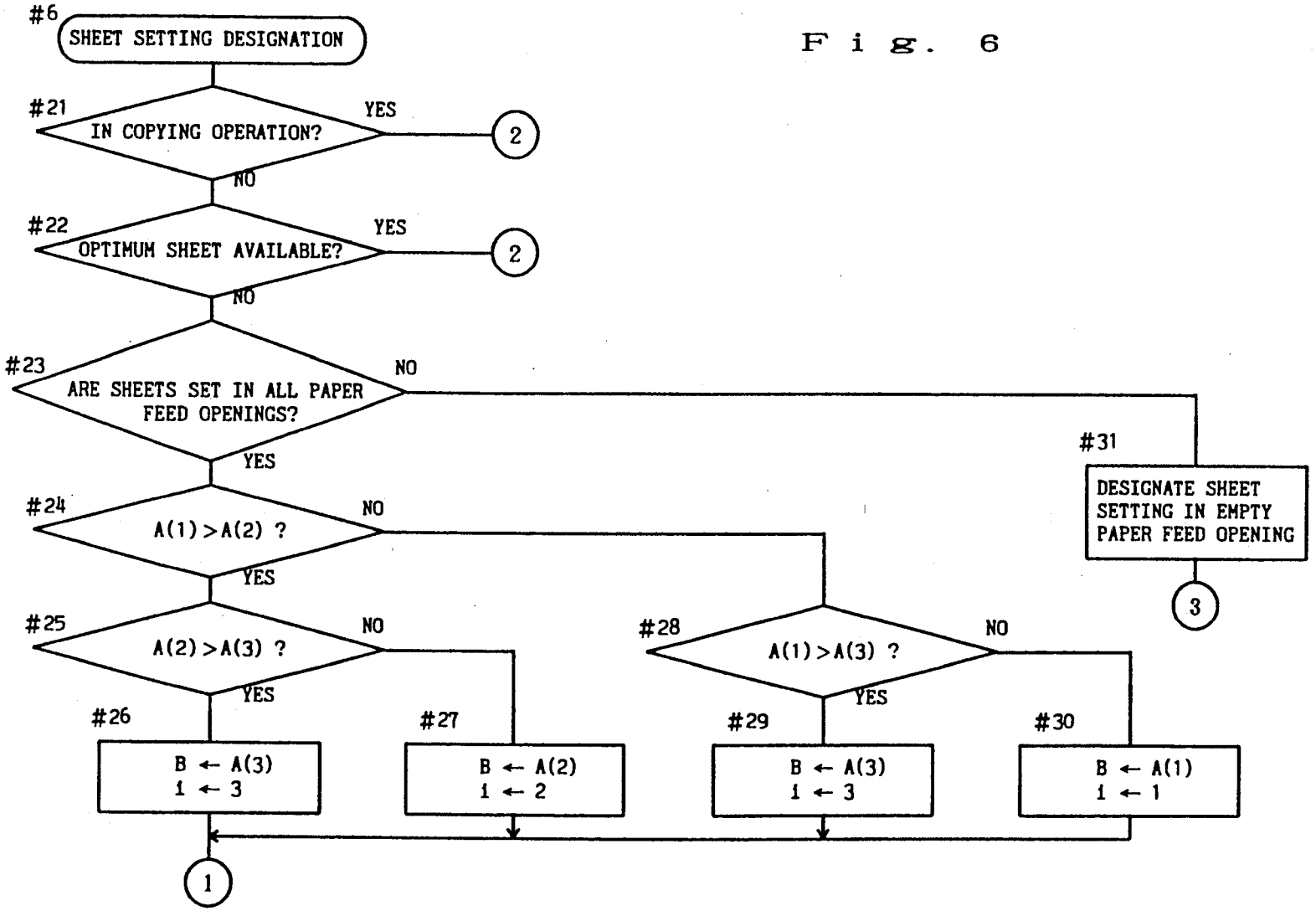
FIGS. 6 and 7 are flowcharts showing subroutines in a sheet setting designation operation processing in FIG. 4.
Figure 7:
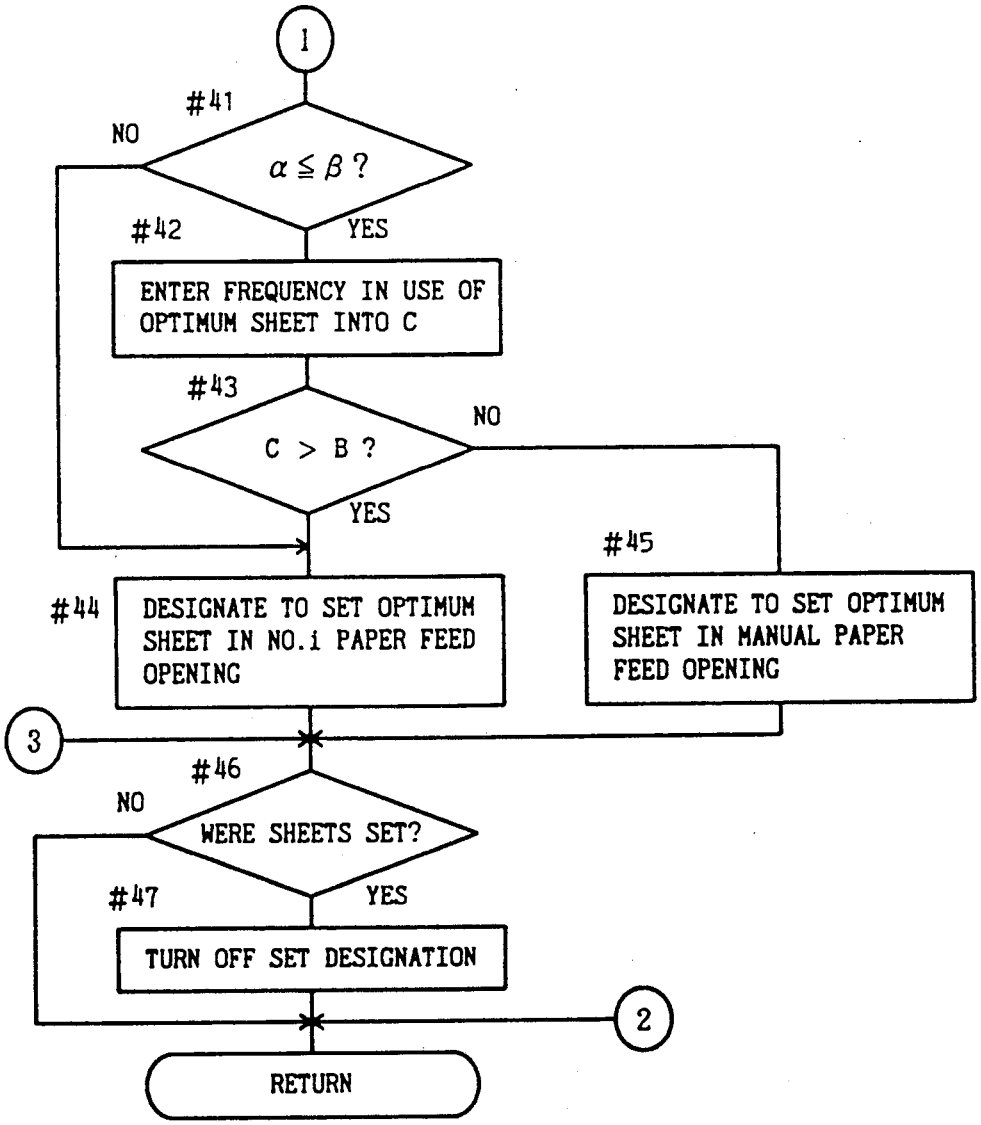

FIGS. 6 and 7 are flowcharts showing subroutines for set designation process at the step #6. In this embodiment, the manual insertion paper feed opening 22 is considered the same as the case the optimum size of transfer sheet selected is set at the step #4. At step #21, judgment is made whether copying operation is being conducted or not. When copying operation is being conducted, program is returned as it is. If copying operation is not being conducted, judgment is made whether a transfer sheet of the optimum size is set or not. In the case where a transfer sheet of the optimum size is set, program is returned as it is. If a transfer sheet of the optimum size is not set, judgment is made whether or not the paper feed cassettes 23–25 are mounted on all of the paper feed openings 27–29 (step #23). When the paper feeds cassettes 23–25 are mounted on all the paper feed openings 27–29, steps #24–#30 in the flow are executed. A transfer sheet which is used least among the sheets set is selected hereat. In this flow, A(n) means all the used number of transfer sheets set in No.n paper feed opening, and on the transfer sheets which have so far been used, the value counted on each size by the processing in FIG. 5 is called each time when it is necessary.

At steps #24, #25, and #28, comparison is made on the sizes A(1), A(2) and A(3). When a judgment is made that the size of transfer sheet set in No.n paper feed opening is used least, A(n) is stored into B at steps #26, #27, #29, #30, and n is entered into i. Then, judgment is made whether or not the designated number of copy sheets $\alpha$ exceeds the maximum permissible number of sheets $\beta$ (step #4). When $\alpha$ is equal to $\beta$ or less than $\beta$, the number of optimum size of sheets used is stored in C (step #42). Comparison is then made between the C and said B (step #43). When C is larger, priority is given to a transfer sheet of the optimum size to be set in No.i paper feed opening, and an indication as shown in FIG. 8, for instance, is made by the LCD101 (step #44). At step #41, in the case where $\alpha$ exceeds $\beta$, it causes the use of the manual paper opening 22 inconvenient, and therefore, program is moved to step #44 to conduct the same process. When the number of use of a transfer sheet of the optimum size C is smaller than B at step #43, an indication as illustrated in FIG. 9, for instance, is made by the LCD101 to set a transfer sheet of the optimum size in the manual paper feed opening 22 (step #45) since it causes inconvenience if a priority is given to a transfer sheet of the optimum size to the transfer sheet already set in the paper feed opening 27–29.

At step #23, if there is a paper feed opening 22–29 to which the paper feed cassette 23–25 is not mounted, an indication is made by the LCD101 to set a transfer sheet of the optimum size in a paper feed cassette which is to be mounted on the empty paper feed opening (step #31). After designating a paper feed cassette to which a transfer sheet of the optimum size is to be set at steps #31, #44, #45, judgment is made whether the sheet is set or not. When the sheet is set, an indication for designating the sheet to be set is turned off (steps #46, #47). Accordingly, when there is a paper feed opening which is not being used, a transfer sheet of the optimum size can be set therein by designating the opening in a manner as described above without exerting any influence on others.

When sheets are set in all the paper feed openings, and a transfer sheet of the optimum size is not used so frequently compared with other sheets set in each of the paper feed openings, designation is made to set a transfer sheet of the optimum size in the manual insertion paper feed opening. On the contrary, when a transfer sheet of the optimum size is frequently used compared with other sheets, designation is made to set the transfer sheet in a paper feed opening where a sheet which is used least is set. In other words, when a transfer sheet of the optimum size is not used so frequently, it is arranged to set the sheet in the manual paper feed opening avoiding a paper feed opening wherein a transfer sheet which is frequently used is set. Further, if there is a paper feed opening which is used for a transfer sheet whose frequency in use is less than a transfer sheet is set in a paper feed opening which is used least. In the case where the frequency in use of the sheets set in all the paper feed openings is higher than a sheet of the optimum size, the sheet of the optimum size can be set in the manual paper feed openings is higher than a sheet of the optimum size, the sheet of the optimum size can be set in the manual paper feed opening so that the convenience for replacing the sheet in frequent use with the sheet of optimum size can be avoided.

Figure 10:
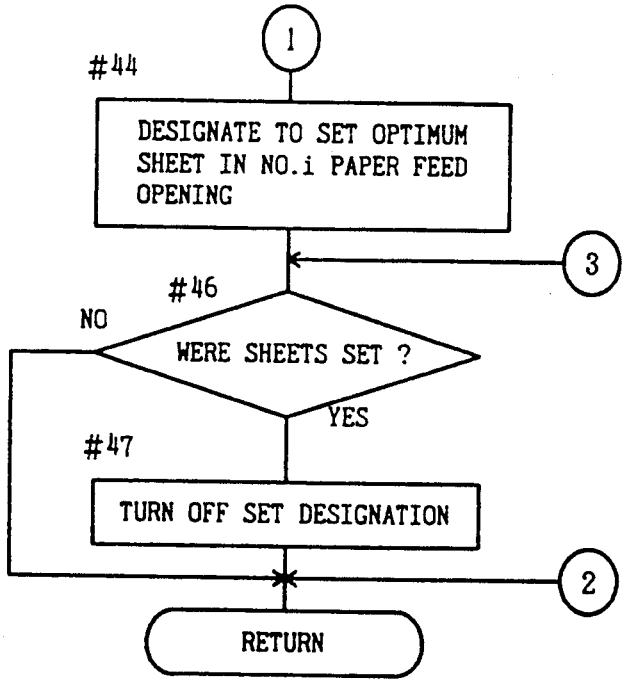
FIG. 10 is a flowchart showing a part of a subroutine for sheet setting designation operation processing to which a second embodiment of the present invention is applied.

FIG. 10 is a flowchart showing a part of a set designating process to which a second embodiment of the present invention is applied. In this embodiment, the manual paper feed opening 22 is not included in a sheet setting mechanism. Accordingly, steps #41–#43 and #45 in FIG. 7 in the first embodiment of the present invention is omitted. After the process in FIG. 6 in the first embodiment is finished, program proceeds to a flow illustrated in FIG. 10, and steps #44, #46 and #47 are subsequently executed. In this case, control is simplified, and an inconvenience for forcibly using the manual insertion paper feed opening can be avoided.

Figure 11:
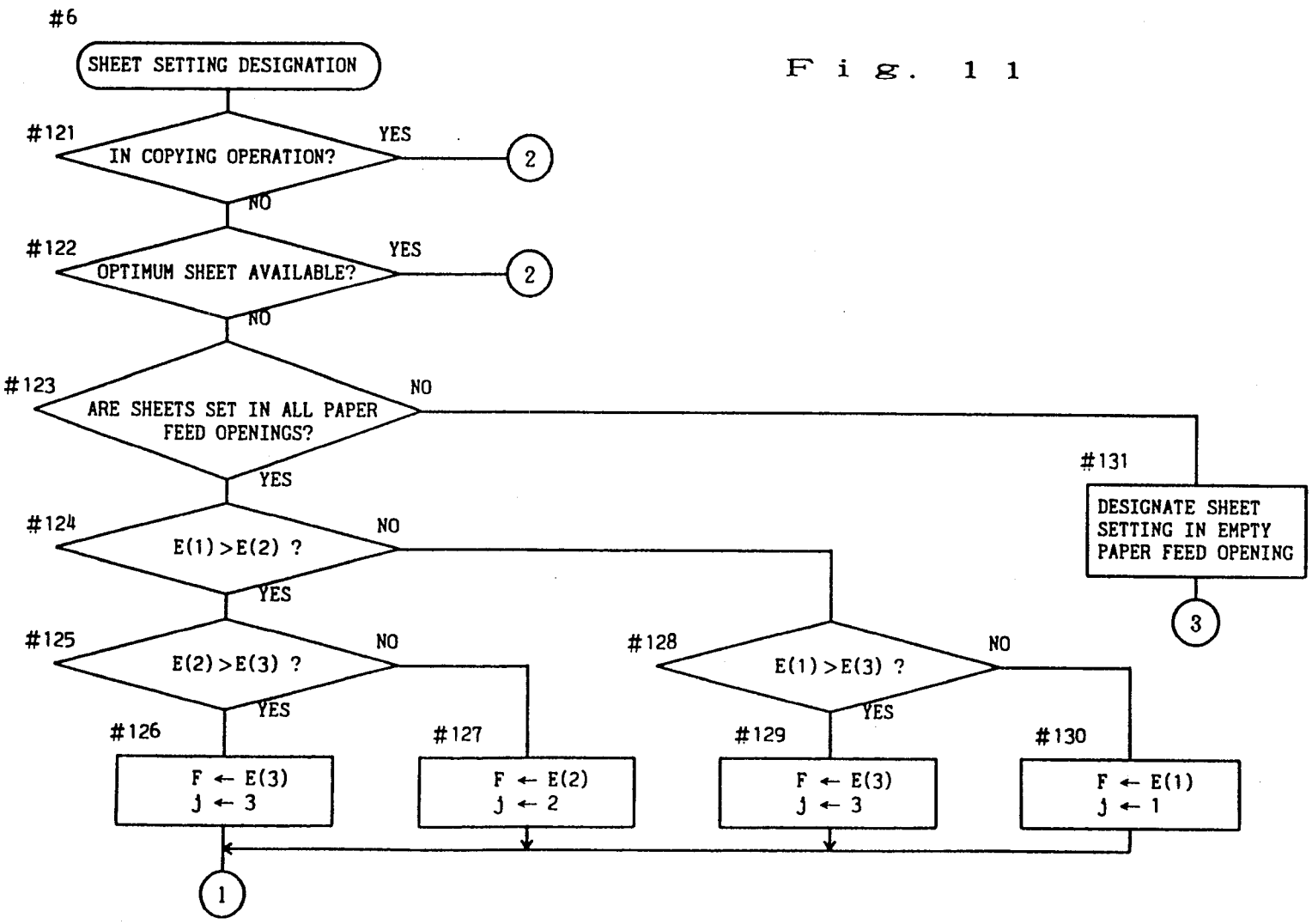
FIGS. 11 and 12 are flowcharts showing subroutines for sheet setting designation operation processing to which a third embodiment of the present invention is applied.
Figure 12:
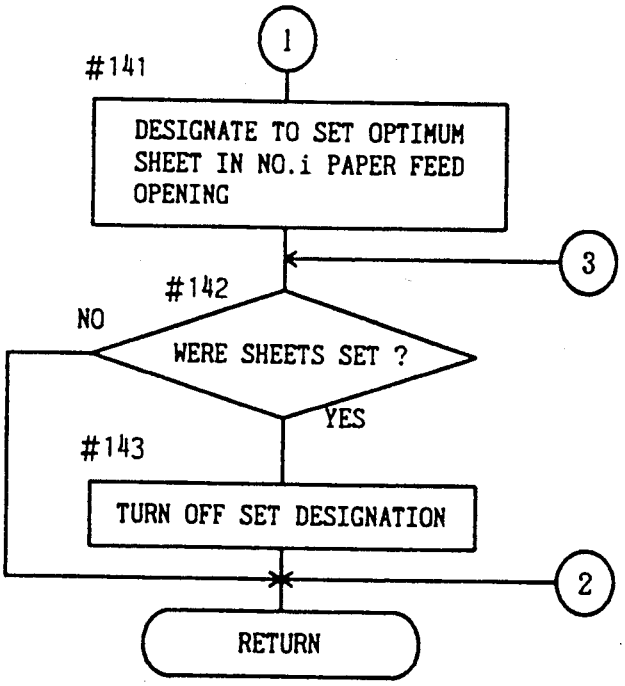

FIGS. 11 and 12 show a third embodiment of the present invention wherein a paper feed cassette 23–25 in which transfer sheet is remained least is designated to be replaced with a paper feed cassette in which a determined transfer sheet of the optimum size is to be set. When a transfer sheet of the optimum size is determined at step #4 in the main routine, judgment is made whether a copying operation is being conducted or not at step #121. In the case where the copying operation is being conducted, program is returned as it is. If the copying operation is not being conducted, judgment is made at step #122 whether a transfer sheet of the optimum size is set, program is returned as it is. If a transfer sheet of the optimum size is not set, judgment is then made whether or not the paper feed cassettes 23–25 are mounted on all the paper feed opening 27–29 (step #123). If there is a paper feed cassette on the empty paper feed opening (step #131). When the paper feed cassettes 23–25 are mounted on all the paper feed openings 27–29, steps #124–130 of the flow are executed. At this stage, a transfer sheet which is remained least is selected among the transfer sheets set. In this flow, E(n) means the remaining number of transfer sheets set in No.n paper feed opening. The remaining number of transfer sheets on each size are stored in memory and they can be read when required.

At steps #124, #125, #128, comparison is made on the sizes of E(1), E(2), and E(3). When a judgment is made at steps #124, #125 and #128 that a sheet set in No.n paper feed opening is remained least, E(n) is stored in F at steps #126, #127, #129 and #130, and n is entered in j. Then, designation is made to set a transfer sheet of the optimum size in No.j paper feed opening (step #141).

After designating a paper feed opening to set a transfer sheet of the optimum size at step #141, judgment is made whether the designated sheet is set or not. When the designated sheet is set, an indication designating the paper feed opening is turned off (steps 142, #143).

In this embodiment, a transfer sheet of the problem size is set in place of the sheet already set basing on the number of sheets remained, whereas in the preceding embodiment, it is based on the frequency the sheet is used. It may, therefore, be arranged to properly utilize the manual insertion paper opening as in the preceding embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention they should be construed as being included therein.

What is claimed is:

1. An image forming apparatus, comprising:

a plurality of paper feed openings capable of setting different kinds of sheets for feeding the sheets for image forming operations;

means for determining an optimum kind of sheet corresponding to a condition of the image forming operation;

detecting means for detecting a paper feed opening wherein an optimum kind of sheet is set; and control means for designating a paper feed opening to which the optimum kind of sheet has to be set when an opening in which the optimum kind of sheet is set is not detected by the detecting means.

2. The image forming apparatus as defined in claim 1, wherein the kind of sheet means the size of sheet.

3. The image forming apparatus as defined in claim 2, wherein the size of sheet includes different directions to which the same size of sheet is fed.

4. An image forming apparatus which is arranged to selectively feed sheets from a plurality of paper feed openings, comprising:

means for judging the frequency in use of the sheets set in each one of the plurality of paper feed openings;

means for determining an optimum kind of sheet for a desired image forming operation;

sheet detecting means for detecting whether sheets are set or not in each one of the plurality of paper feed openings;

means for detecting a kink of sheet set in each one of the plurality of paper feed openings; and control means for giving instructions to set the optimum kind of sheet of a paper feed opening whose frequency in use is the lowest among the plurality of the paper feed openings when sheets are set in all the plurality of paper feed openings and the optimum kind of sheet is not set in any one of the paper feed openings.

5. The image forming apparatus as defined in claim 4, wherein the kind of sheet means the size of sheet.

6. The image forming apparatus as defined in claim 5, wherein the size of sheet includes different directions to which the same size of sheet is fed.

7. The image forming apparatus as defined in claim 4, wherein the judgment means includes memory means for summing and storing the used number of sheets on each kind of sheet starting from a predetermined period of time, and judges the frequency in use of each paper feed opening based on the content of the memory stored in the memory means and the result of detection conducted by the detecting means.

8. The image forming apparatus as define din claim 4, wherein the control means gives instructions with the optimum size.

9. The image forming apparatus as defined in claim 4, wherein the control means gives instructions to set the optimum kind of sheet in a paper feed opening detected by the sheet detecting means when a paper feed opening wherein any sheet is not set is detected by the sheet detecting means.

10. An image forming apparatus which is arranged to selectively feed sheets from a plurality of paper feed openings, comprising:

means for determining an optimum kind of sheet corresponding to a condition of image forming operation;

sheet detecting means for detecting whether sheets are set or not in each one of the plurality of paper feed openings;

detecting means for detecting a kind of sheet set in each one of the plurality of paper feed openings;

judging means for detecting the remaining amount of sheets set in each one of the plurality of paper feed openings; and control means for giving instructions to set the optimum kind of sheet in a paper feed opening wherein the remaining amount of sheet are least when sheets are set in all the plurality of paper feed openings and the optimum kind of sheet is not set in any one of the paper feed openings.

11. The image forming apparatus as defined in claim 10, wherein the kind of sheet means the size of sheet.

12. The image forming apparatus as defined in claim 11, wherein the size of sheet includes different directions to which the same size of sheet is fed.

13. The image forming apparatus as defined in claim 10, wherein the judging means includes means for storing the remaining amount of sheets corresponding to each on of the plurality of paper feed openings.

14. The image forming apparatus as defined in claim 10, wherein the control means gives instructions to set the optimum kind of sheet in a paper feed openings detected by the sheet detecting means when the paper feed opening wherein any sheet is not set is detected by the sheet detecting means.

15. An image forming apparatus which is provided with a plurality of paper feed means for feeding different kinds of sheets and manual paper feed means, comprising:

counting means for counting used number of sheets of each kind of sheet;

sheet selecting means for selecting an optimum kind of sheet corresponding to a condition of an image forming operation;

sheet detecting means for detecting whether sheets are set or not in each one of the plurality of paper feed means;

detecting means for detecting a kind of sheet set in each one of the plurality of paper feed means; and control means for giving instructions to set an optimum kind of sheet in the manual paper feed means when the frequency in use of the optimum kind of sheet is lowest wherein comparison is made between the used number of sheets set in the plurality of paper feed means and the used number of the optimum kind of sheets when sheets are set in all the plurality of paper feed means and the optimum kind of sheet is not set in any one of the paper feed means.

16. The image forming apparatus as defined in claim 15, wherein the control means gives instructions to set a sheet of the optimum kind in a paper feed means when there is a paper feed means accommodating a sheet whose frequency in use is lower than the optimum kind of sheet.

17. The image forming apparatus as defined in claim 15, wherein the apparatus is further provided with means for inputting the number of sheets required for an image forming operations, and the control means gives instructions to set the optimum kind of sheet in the manual paper feed means upon making comparison between the number of sheets required for an image forming operation and the maximum number of sheets which can be accommodated in the manual paper feed means and when the maximum number of sheets which can be accommodated in the manual paper feed means is judged larger than the number of sheets required for the image forming operation.

* * * * *

UNITED STATES PATENT AND TRADEMARK OFFICE

CERTIFICATE OF CORRECTION

ATENT NO. : 5,153,641

ATED : October 6, 1992

VENTOR(S) : Kenichi Takahashi

It is certified that error appears in the above-identified patent and that said Letters Patent is hereby orrected as shown below:

In Col. 2, line 6, change "kink" to --kind--.

In Col. 6, line 32, change "step #4" to --step #41--.

In Col. 7, line 12, after "transfer sheet", insert --of the optimum size, the optimum size transfer sheet--.

In Col. 7, line 17, change "openings" to --opening--.

In Col. 7, lines 17-19, delete "is higher than a sheet of the optimum size, the sheet of the optimum size can be set in the manual paper feed opening".

In Col. 7, line 19, change "convenience" to --inconvenience--.

In Col. 7, line 46, after "is set" and before "," (comma), insert --. When a transfer sheet of the optimum size is set--.

In Col. 7, line 49, change "opening" to --openings--.

UNITED STATES PATENT AND TRADEMARK OFFICE

CERTIFICATE OF CORRECTION

ATENT NO. : 5,153,641

ATED : October 6, 1992

NVENTOR(S) : Kenichi Takahashi

It is certified that error appears in the above-identified patent and that said Letters Patent is hereby orrected as shown below:

In Col. 7, line 51, between "paper feed" and "cassette", .nsert --opening 27-29 to which the paper feed cassette 23-25 .s not mounted, designation is made to set a paper feed--.

:n Col. 8, line 6, change "problem" to --optimum--.

In Col. 8, line 51 (Claim 4, line 12), change "kink" to ·-kind--.

In Col. 8, line 54 (Claim 4, line 15), change "of" (second occurrence) to --in--.

In Col. 8, line 66 (Claim 7, line 2), change "judgement" :o --judging--.

In Col. 9, line 5 (Claim 8, line 1), change "define din" :o --defined in--.

In Col. 9, line 30 (Claim 10, line 17), change "sheet" :o --sheets--.

In Col. 9, line 42 (Claim 13, line 4), change "on" to ·-one--.

UNITED STATES PATENT AND TRADEMARK OFFICE

CERTIFICATE OF CORRECTION

ATENT NO. : 5,153,641

ATED : October 6, 1992

NVENTOR(S) : Kenichi Takahashi

It is certified that error appears in the above-identified patent and that said Letters Patent is hereby orrected as shown below:

In Col. 9, line 45 (Claim 14, line 3), change "openings" to --opening--.

In Col. 10, line 36 (Claim 17, line 4), change "operations" to --operation--.

Signed and Sealed this

Twenty-eighth Day of September, 1993

Bruce Lehman

*Attest:*

BRUCE LEHMAN

*Attesting Officer*

*Commissioner of Patents and Trademarks*